US005323579A

United States Patent [19]

Ruff

[11] Patent Number: 5,323,579

[45] Date of Patent: Jun. 28, 1994

[54] DOOR WINDOW GLASS AND FRAME ASSEMBLY

[75] Inventor: Robert O. Ruff, Cincinnati, Ohio

[73] Assignee: Masco Industries, Inc., Taylor, Mich.

[21] Appl. No.: 991,138

[22] Filed: Dec. 16, 1992

[51] Int. Cl.[5] ..... E06B 3/70

[52] U.S. Cl. ..... 52/455; 52/208; 52/476

[58] Field of Search ..... 52/455, 208, 213, 214, 52/397, 476, 585, 822, 204.69, 715, 773, 774; 24/293

[56] References Cited

U.S. PATENT DOCUMENTS

| | | | |
|---|---|---|---|
| D. 251,741 | 5/1979 | Smallwood et al. . | |
| 2,840,202 | 6/1958 | Hehr | 52/214 |
| 3,308,588 | 3/1967 | Von Wedel | 52/208 |
| 3,487,602 | 1/1970 | Braun et al. | 52/455 |
| 3,503,168 | 3/1970 | Eggert, Jr. | 52/208 |
| 3,704,563 | 12/1972 | Waller | 52/455 |
| 3,760,543 | 9/1973 | McAllister | 52/455 X |
| 3,869,839 | 3/1975 | Johnson | 52/204.69 |
| 3,903,669 | 9/1975 | Pease, Jr. et al. . | |
| 3,969,857 | 7/1976 | Stark | 52/208 |
| 4,021,967 | 5/1977 | Mulder | 52/208 X |
| 4,241,556 | 12/1980 | Bursk | 52/455 |
| 4,259,818 | 4/1981 | Stark | 52/208 |
| 4,430,836 | 2/1984 | McKann | 52/455 |
| 4,498,261 | 2/1985 | Wilson | 52/208 X |
| 4,550,542 | 11/1985 | La See | 52/455 X |
| 4,570,399 | 2/1986 | Wentink . | |
| 4,583,342 | 4/1986 | Lier | 52/208 X |
| 4,628,648 | 12/1986 | Winyard . | |
| 4,637,182 | 1/1987 | Ellsworth | 52/455 X |
| 4,897,975 | 2/1990 | Artwick | 52/773 X |
| 4,920,718 | 5/1990 | Artwick | 52/455 X |
| 4,947,606 | 8/1990 | La See | 52/455 |
| 5,018,330 | 5/1991 | Lewkowitz . | |
| 5,105,597 | 4/1992 | Wilkening | 52/455 |
| 5,133,168 | 7/1992 | Neilly | 52/455 X |

FOREIGN PATENT DOCUMENTS 2174451 11/1986 United Kingdom ..... 24/293

OTHER PUBLICATIONS

Detailed Drawings of an "Aluminum Molding Used To Make Tubular Steel Doors For An Office Partition" by Acme Steel Partition 513 Porter Ave., Brooklyn, N.Y. 11222, Jun. 22, 1987.

*Primary Examiner*—Carl D. Friedman
*Assistant Examiner*—Beth A. Aubrey
*Attorney, Agent, or Firm*—Steven J. Rosen

[57] ABSTRACT

A panel light assembly used in panels. The panel light assembly has a retainer clip for a mounting glazing between two opposing frames that are mounted in apertures in the skins of the panel located on either side of the core of the panel. The retaining clip, preferably made of a springy material, includes longitudinally extending legs depending from opposite longitudinal sides of the clip and which are operable to slide over and securingly engage the panel skins. Oppositely spaced and oppositely directed trim retainer prongs project up from said clip body and generally towards a longitudinal center-line of said clip body for engaging the frames and securing the glazing between the frames in the panels light apertures. The present invention provides at least two skin spacer tabs depending from the clip wherein each of the skin spacer tabs is spaced sufficiently apart from legs so as to be able to receive the skins therebetween. The prongs may be bent up projections cut out from said clip body and may further include a trim release means attached to the projections that are tabs further cut out from the clip. The preferred embodiment of the present invention provides skin apertures with embossed edges indented towards the core along the periphery of each of the apertures wherein the embossed edges are essentially parallel to the surface of the skins. The frames are mounted in the apertures within the embossments such that said frames are flush with the outer surfaces of the skins.

28 Claims, 2 Drawing Sheets

DOOR WINDOW GLASS AND FRAME ASSEMBLY

BACKGROUND OF THE INVENTION

FIELD OF THE INVENTION

This invention relates to light assemblies typically used to mount panes of glass in doors, interior and exterior walls or partitions and particularly to means for mounting a glass pane and surrounding frames in the panel window aperture.

DESCRIPTION OF RELATED ART

Light assemblies used to mount glass panes in the apertures of doors, walls, partitions, and similar structures conventionally include a glass pane, typically being of the single or double glazed type, and mounted in a window aperture of the panel between two frames, often referred to as trim. The frames are used to trap the pane between them and are held in place against the outer surfaces of the panel by a clamping assembly that uses cylindrical fasteners such as bolts, rivets, or the like. In the case of U.S. Pat. No. 3,903,669 a rather complicated and expensive double male ended stud is received in bores in the plastic frames which lacks strength and durability. These fasteners require significant assembly time which increases the cost of construction.

The prior art teaches a glass retainer trim assembly made by ACME STEEL PARTITION of Brooklyn, N.Y., as shown in four drawings in the prior art. Two of the drawings disclose similar assemblies having a retainer clip screwed onto a rectangular tubular structure and engaging a piece of trim. The trim is secured to the rectangular tubular structure by the retainer clip which fits over the outer perimeter of the tubular structure and has a leg with an angled bent edge which fits into a slot in the trim. The clip includes a single prong that engage an edge of the trim that is opposite of and in a direction away from the slot and leg edge within the slot. The prong has a trim engaging surface oriented to produce a tensioning force in the trim in a direction normal to and away from the retainer clip body thereby requiring the slot to hold the trim in place. The edges of the legs are also bent outward to fit into the slot which is cut at an angle to the flat surface of the trim.

The other two drawings disclose assemblies having a retainer clip with legs that fit over the short sides of the rectangular tubular structure and engage a piece of trim. The trim is symmetrically double sided so as to form a channel within the trim that is coextensive with a length of and surrounds a portion of the tubular structure. There are disclosed two oppositely spaced retainer clips wherein each piece of trim engages both of these retainer clips around the outer perimeter of the tubular structure. Each of these retainer clips includes two opposed prongs wherein each prong engages two different trim pieces. Each of these prongs has a trim engaging surface that contacts a leg of the trim normal to the body of the retainer clip and that is oriented to produce a tensioning force in the trim in a direction normal to and away from the retainer clip body thereby requiring the channel to hold the trim in place so that it will not pop off.

Furthermore conventional light assemblies and in particular ones used for metal fire doors have frames that protrude outward from the door's outer surfaces and interfere with door hardware that is mounted thereupon. Such hardware includes but is not limited to a flat bar panic device which is mounted transversely across the door and for which it may not be possible, desirable, or safe to place elsewhere particularly in light of handicap related building and housing codes. Such fire doors often have hollow cores and when exposed to the heat of a fire the metal skins of the door tend to warp inward into the core, particularly around the light, causing the light assembly to fail and thereby reduce the effectiveness of door's fire resistance capability.

The need therefore exists for a panel light that employs fewer parts, parts that are reliable and easy and inexpensive to manufacture and assemble. A further need exists for a panel light assembly that is durable and strong particularly for use in metal doors which serve as fire doors or are relied upon for protection against fires. Another need exists for a panel light assembly that is flush mounted to the door's outer surfaces so that the frames do not protrude above the outer surfaces so as to interfere with the mounting of hardware such as a transversely mounted bar like panic device.

SUMMARY OF THE INVENTION

The present invention provides a panel light assembly that is applicable for, but not limited to, use in panels such as doors, particularly hollow metal doors, and other types of panels such as interior and exterior walls, room partitions, and the like.

A panel light assembly is provided with a retainer clip for a mounting glazing between two opposing frames that are mounted in apertures in the skins of the panel which are on either side of the core of the panel. The retainer clip includes a retainer clip body made of a springy material, preferably spring steel, with longitudinally extending straight legs depending from opposite longitudinal sides of the clip body and which are operable to slide over and securingly engage the panel skins. Oppositely directed and spaced apart trim retainer prongs project up from the clip body and generally towards a longitudinal center-line of the clip body for engaging the frames and securing the glazing between the frames in the panels light apertures. The preferred embodiment of the prongs have frame contacting surfaces that are oriented in a direction perpendicular to the clip body or slightly indented in towards the clip body. A feature of the preferred embodiment of the invention is a bent extension of the prong and a trim contacting surface on the extension such that the extension makes an angle facing towards the center-line of the clip body and the angle with the clip body is not more than 90°.

Another embodiment of the present invention includes at least two skin spacer tabs depending from the clip body wherein each of the skin spacer tabs is spaced sufficiently apart from legs so as to be able to receive the skins therebetween. Yet another embodiment includes prongs are that are bent up projections cut out from the clip body and further provides a trim release means attached to the projections that are tabs further cut out from the clip body. The preferred embodiment provides for staggered prongs that provides a transversely extending portion of the clip between the prongs and upon which is formed a transversely extending stiffening rib.

The preferred embodiment of the present invention provides skin apertures with embossed edges indented towards the core along the periphery of each of the apertures wherein the embossed edges are essentially parallel to the surface of the skins. The frames are mounted in the apertures within the embossments such that the frames are flush with the outer surfaces of the skins.

A more particular embodiment of the present invention provides a metal door with metal skins that is particularly useful as a fire door and provides at least one bar shaped panic device that is mounted on an outer surface of one of the skins and overlapping a portion of one of the frames.

ADVANTAGES

The present invention provides many advantages such as ease of assembly and, in case the glazing breaks, disassembly of the panel light assembly. The assembly of the present invention is relatively inexpensive and is strong and durable while at the same time easily disassembled and reassembled. The present invention requires less assembly time than prior art devices which decreases the cost of construction of light assemblies in panels.

The present invention provides the advantage of being able to flush mount hardware on the panels surface over portions of the frames of the panel light assembly. This is particularly advantageous for metal fire doors wherein the frames do not protrude outward from the door's outer surface and do not interfere with hardware mounted thereupon such as a bar shaped panic device mounted transversely across the door. This provides an additional advantage for meeting the needs of handicapped people in wheel chairs where the light and the door hardware must be at about the same level on the door particularly where required by related building and housing codes. Another advantage of the present invention is enhanced fire resistance of the doors by resisting the tendency of the metal skins of the doors to warp inward into the core, particularly around the light. This enhances the integrity of the light assembly and improves the effectiveness of door's fire resistance capability.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
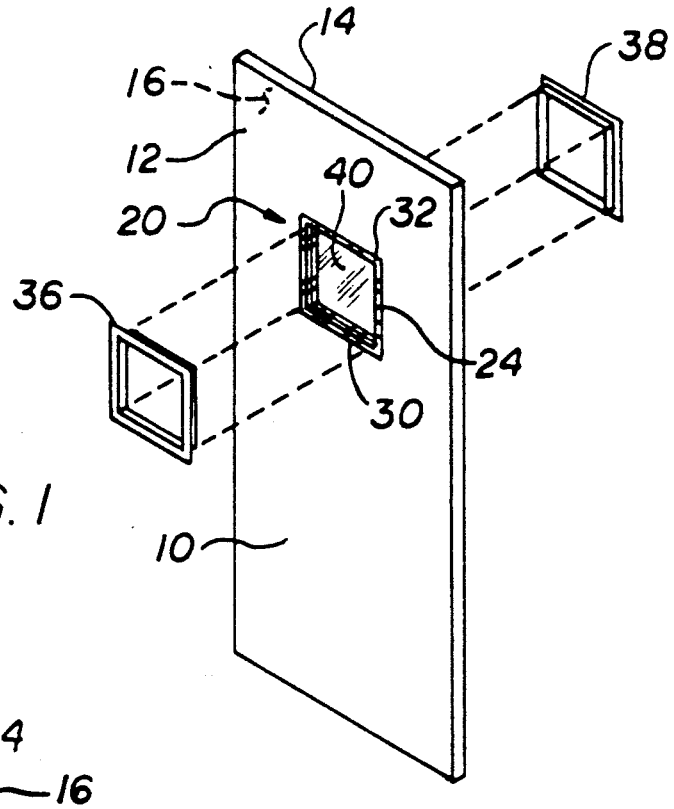
FIG. 1 is a perspective view of a door with a partially exploded view of a light assembly in accordance with one embodiment of the present invention.

The door 10 illustrated in FIG. 1 is an example of a type of panel in the form of a hollow steel door 10 having a panel light assembly 20 in accordance with the present invention. The door 10 has a front skin 12 spaced apart from a back skin 14 and both are preferably made of metal with a preferably hollow core 16 therebetween. The terms front and back are arbitrarily assigned for the purpose of clarity in this description and are in fact interchangeable with respect to the skins. The door 10 has a panel light assembly 20 with corresponding panel light apertures 24 in each of the skins 12 and 14 which are shown in greater detail in FIG. 2. The panel light assembly 20 uses a spaced apart plurality of retainer clips 30 which are designed to fit over an inwardly (in towards the core) indented embossed edge 32 along periphery 33 of each of the apertures 24. Furthermore the embossed edges 32 are flat and essentially parallel to the remainder of the skins 12 and 14 and to effectively engage the retainer clip 30 and front and back frames 36 and 38 (shown in FIG. 1) respectively which mount and secure the light's glazing 40 which is typically single or double glazed but may have more layers.

Figure 2:
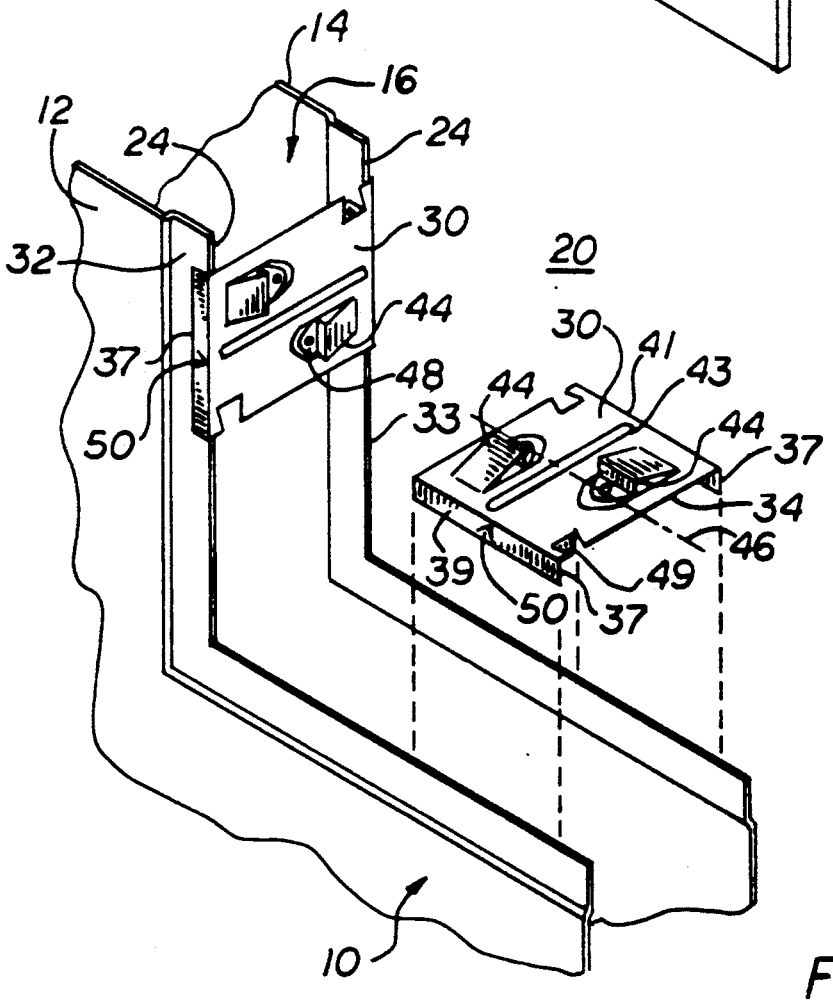
FIG. 2 is an enlarged perspective view of a portion of the light assembly depicted in FIG. 1 showing installation of the retaining clips.
Figure 3:
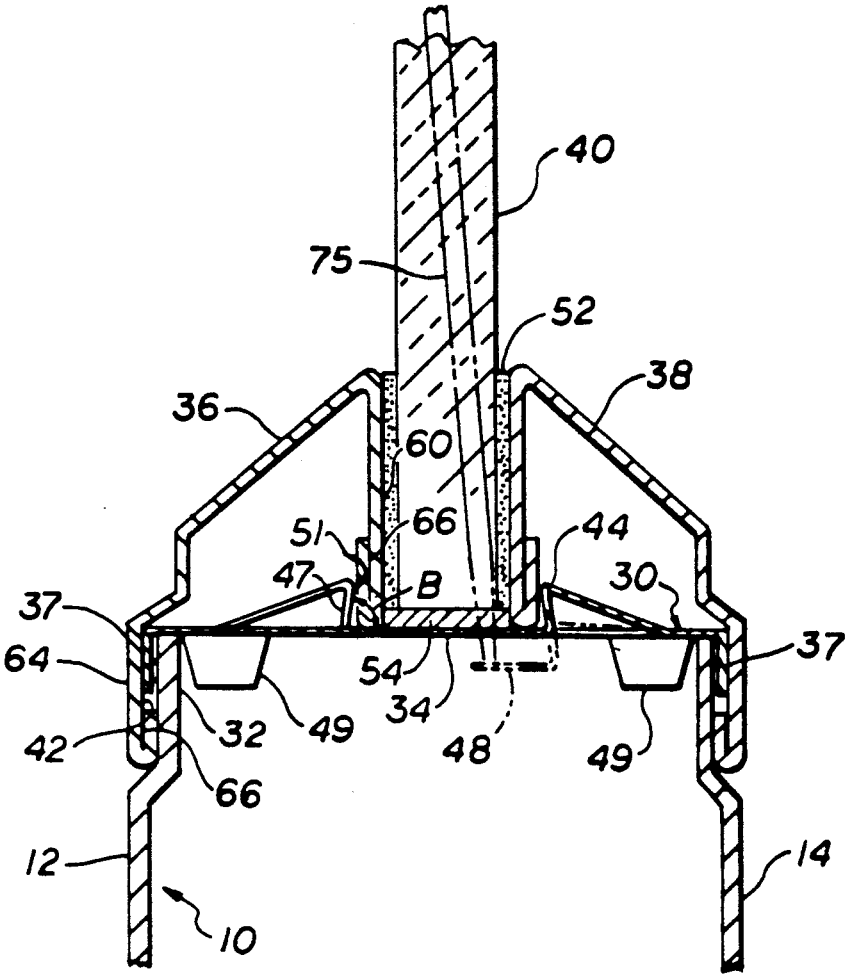
FIG. 3 is a partial sectional view of a portion of the light assembly depicted in FIG. 1.

Referring more specifically to FIGS. 2 and 3, the retainer clips 30 are constructed of a springy material preferably a spring steel and have a clip body 34 and longitudinally extending straight clip legs 37 depending from opposite longitudinal front and back sides 39 and 41 respectively of the clip body 34 such that the clip legs 37 fit flush against the indented embossed edges 32 and do protrude above the outer surfaces of skins 12 and 14. The retainer clip 30 has at least two prongs 44 projecting up from the clip body and generally towards a longitudinal center-line 46 of the clip body 34. A feature of the preferred embodiment of the invention is a bent extension 47 of the prong 44 and a trim contacting surface 51 on the extension such that the extension makes an angle B facing the longitudinal center-line (46 in FIG. 1) of the clip body 34 and makes an angle B with the clip body that is not more than 90°. A bent over extension 47 of prong 44 at an angle B equal to 85° from the clip body 34 provides an advantageous orientation of the trim contacting surface 51. This prevents the prong 44 from producing a force on the frame 36 away from the clip body 34 that would tend to dislodge the frame from the clip 30.

The prongs 44 are bent up projections cut out from the clip body 34 and have attached to their distal ends a trim release means in the form of release tabs 48 which are further cut out from the clip body. If the glazing 40 is broken it may be removed and then the trim release tabs 48 may be depressed by a simple tool such as a screw driver blade 75 in order to release the frames 36 and 38. Then a new piece of glazing may be installed using the old frames and retainer clips 30.

Referring with particularity to FIG. 2, at least one inwardly directed barb 50 is disposed on each of the clip legs 37 for securing the retainer clip 30 to the skins 12 and 14. At least two skin spacer tabs 49 depend from the clip body 34 and each of the skin spacer tabs is spaced sufficiently apart from the longitudinally extending clip legs 37 so as to be able to hold the skins 12 and 14 between the legs and spacer tabs. This feature helps the door to resist the tendency of the skins to warp and helps preserve the integrity of the light assembly when exposed to the high temperature heat of a fire. Preservation of the light assembly integrity and its glazing enhances the door's ability to function as a fire break. Another feature of the preferred embodiment is a stiffening rib 43 that is disposed transversely down the middle of the clip body 34.

Referring more particularly to FIG. 3, each of the frames as illustrated by front frame 36 has an inner frame leg 60 and an outer frame leg 64 with flush bent over walls 66. The frame 36 is secured by a shoulder the prong 44 pushing on the an inner frame leg 60 which in turn puts the frame in tension because the outer frame leg 64 is restrained by the indented embossed edge 32. The flushness of the frame 36 and in particular the outer frame leg 64 with the outer surfaces of skins 12 and 14 is enhanced by the bent over wall 66 being approximately as thin as the clip leg 37 which is received within a channel 42 formed between the outer frame leg 64 and the indented embossed edge 32 as bounded by the bent over walls 66. The combined thickness of the outer frame leg 64 and the bent over wall 66 is equal to or slightly less than the indentation between the outer surfaces of the skins 12 and indented embossed edge 32. The frame 36 need not be flush the outer surfaces of the skins 12 and 14 but preferably should not protrude outwardly beyond these surfaces and fit within the embossment formed by the indented embossed edges 32.

Illustrated more particularly in FIG. 3, is the retainer clip 30 which engages the frames 36 and 38 thereby securing the glazing 40 between the frames. A layer of putty 52 is used between the frames 36 and 38 and the glazing 40. Optional conventional glazing blocks 54 made of rubber loosely disposed between the glazing 40 and the clip bodies 34 may also be used to help center and support the glazing 40. The blocks 54 are usually put on the bottom retainer clips 30 to prevent the glazing 40 from contacting metal but may also be used on the top and vertical sides if so desired. Removal of the light assembly 20 is required usually only to replace the glazing 40 such if it is broken or cracked. The broken remains of the glazing 40 is removed, the putty cleaned away, and the blocks 54 withdrawn. Then the trim release tabs 48 may are accessible to be depressed by the screw driver blade 75 which in turn depresses trim contact surface 51 from engagement with inner wall 66 in order to release the frames 36 and 38.

Figure 4:
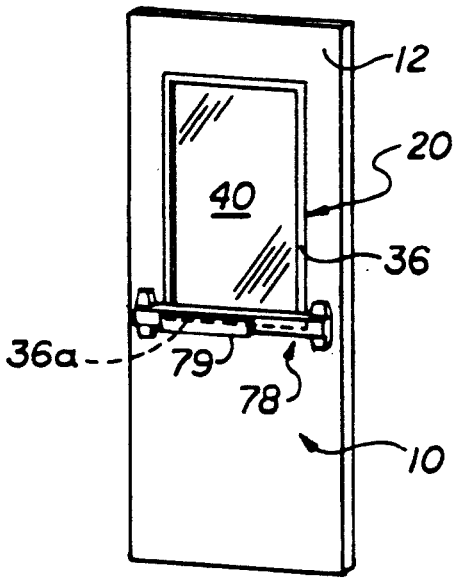
FIG. 4 is a perspective view of a door with a light assembly and panic device mounted on the door in accordance with one embodiment of the present invention.

The door 10 illustrated in FIG. 4 is designed to accommodate people in wheel chairs and the panel light assembly 20 extends low enough on the door to allow people in wheel chairs as well as people standing upright to see through the glazing 40. Further in accordance with the present invention, the door 10 has a panel light assembly 20 including the front frame 36 substantially flush mounted with the doors front skin 12. A panic device 78 includes a button 79 to unlatch the door 10 and is transversely mounted flush against the door 10 on the surface of the front skin 12 and overlaps a portion 36*a* of the frame 36. This feature enhances the operation of the panic device by allowing the door to accommodate people in both wheel chairs and standing upright in an efficient manner with enhanced ease of operation and for a wide variety of conditions.

The door light assembly invention discussed above illustrates embodiments of the present invention for use in a door but other embodiments of the present invention are contemplated for other types of light installations in other types of partitions such as interior and exterior walls of residential, commercial, and industrial buildings.

While the preferred embodiment of the present invention has been described fully in order to explain its principles, it is understood that various modifications or alterations may be made to the preferred embodiment without departing from the scope of the invention as set forth in the appended claims.

I claim:

1. A retainer clip for a panel light assembly having glazing mounted between two opposing frames, said panel light assembly mounted in an aperture in a panel having two spaced apart panel skins, said retainer clip comprising:

a retainer clip body including opposite longitudinal sides and made of a springy material, longitudinally extending legs depending from said opposite longitudinal sides of said clip body operable to slide over and securingly engage the panel skins, oppositely directed and spaced apart trim retainer prongs projecting up from said clip body and generally towards a longitudinal center-line of said clip body for engaging the frames and securing the glazing between the frames in the panel, and a bent extension of said prong and a trim contacting surface on said extension such that said extension makes an angle with said clip body wherein said angle faces said longitudinal center-line and said angle is not more than 90°.

2. A retainer clip as claim in claim 1 further comprising trim release means operably attached to said prongs for releasing said prongs from engagement with the frames.

3. A retainer clip as claim in claim 2 further comprising at least two skin spacer tabs depending from said clip body and each of said skin spacer tabs spaced sufficiently apart from said longitudinally extending legs so as to be able to receive the skins therebetween.

4. A retainer clip as claim in claim 3 wherein said springy material is spring steel.

5. A retainer clip as claim in claim 4 further comprising at least one barb disposed on each of said legs for securing the retainer clip to the skins.

6. A retainer clip as claim in claim 5 wherein said prongs are bent up projections cut out from said clip body and said trim release means are tabs further cut out from said clip body.

7. A retainer clip as claim in claim 6 wherein said skin spacer tabs are staggered and said clip body further comprises a stiffening rib transversely disposed between said staggered skin spacer tabs.

8. A retainer clip for a panel light assembly having glazing mounted between two opposing frames, said panel light assembly mounted in an aperture in panel having two spaced apart panel skins, said retainer clip comprising:

a retainer clip body including opposite longitudinal sides and made of a springy material, longitudinally extending legs depending from said opposite longitudinal sides of said clip body operable to slide over and securingly engage the panel skins, oppositely directed and spaced apart trim retainer prongs projecting up from said clip body and generally towards a longitudinal center-line of said clip body for engaging the frames and securing the glazing between the frames in the panel, and trim release means operably attached to said prongs for releasing said prongs from engagement with the frames.

9. A retainer clip as claim in claim 8 wherein said prongs are bent up projections cut out from said clip body and said trim release means are tabs further cut out from said clip body.

10. A retainer clip as claim in claim 9 further comprising at least two skin spacer tabs depending from said clip body and each of said skin spacer tabs spaced sufficiently apart from said longitudinally extending legs so as to be able to receive the skins therebetween.

11. A retainer clip as claim in claim 10 further comprising at least one barb disposed on each of said legs for securing the retainer clip to the skins.

12. A retainer clip as claim in claim 11 wherein said skin spacer tabs are staggered and said clip body further comprises a stiffening rib transversely disposed between said staggered skin spacer tabs.

13. A retainer clip for a panel light assembly having glazing mounted between two opposing frames, said panel light assembly mounted in an aperture in a panel having two spaced apart panel skins, said retainer clip comprising:

a retainer clip body including opposite longitudinal sides and made of a springy material, longitudinally extending legs depending from said opposite longitudinal sides of said clip body operable to slide over and securingly engage the panel skins, oppositely directed and spaced apart trim retainer prongs projecting up from said clip body and generally towards a longitudinal center-line of said clip body for engaging the frames and securing the glazing between the frames in the panel, and at least two skin spacer tabs depending from said clip body and each of said skin spacer tabs spaced sufficiently apart from said longitudinally extending legs so as to be able to receive the skins therebetween.

14. A retainer clip as claim in claim 13 further comprising at least one barb disposed on each of said legs for securing the retainer clip to the skins.

15. A retainer clip as claim in claim 14 wherein said skin spacer tabs are staggered and said clip body further comprises a stiffening rib transversely disposed between said staggered skin spacer tabs.

16. A retainer clip as claim in claim 15 wherein said springy material is spring steel.

17. A panel light assembly for a panel having two spaced apart panel skins and an inner core therebetween, said light assembly comprising:

corresponding panel light apertures in each of said skins, said skins having outer surfaces, an embossed edge along the periphery of at least one of said apertures, said embossed edge indented towards said core, and first and second frames mounted on said outer surfaces of the skins and said frames disposed within embossments formed by said indented embossed edges such that said frames do not protrude outwardly of their respective outer surfaces, a plurality of spaced apart retainer clips disposed over said embossed edges for securing said frames and glazing disposed therebetween within said panel light apertures, each of said retainer clips comprising:

a retainer clip body made of a spring steel, longitudinally extending legs depending from opposite longitudinal sides of said clip body said legs flush mounted against said embossments, and oppositely directed and spaced apart trim retainer prongs projecting up from said clip body and generally towards a longitudinal center-line of said clip body, said prongs engaging said frames and securing said glazing between said frames and securing said frames to at least one of said embossments and said legs.

18. A panel light assembly as claimed in claim 17 wherein said retainer clip further comprises at least two skin spacer tabs depending from said clip body and each of said skin spacer tabs is spaced sufficiently apart from said longitudinally extending legs so as to be able to receive said skins therebetween and at least one inwardly directed barb disposed on each of said legs for securing said retainer clip to said skins.

19. A panel light assembly as claimed in claim 18 wherein said prongs are bent up projections cut out from said clip body and said trim release means are tabs further cut out from said clip body.

20. A metal door comprising:

two spaced apart metal skins and an inner core therebetween, a panel light assembly comprising;

corresponding panel light apertures in each of said skins, an embossed edge along the periphery of each of said apertures, said embossed edges forming embossments indented towards said core and essentially parallel to said skins, said skins having outer surfaces and front and back frames mounted on said outer surfaces of respective ones of said front and back skins within said embossments such that said frames are substantially flush with said outer surfaces, retainer clips disposed over edges of said embossments for securing said frames and glazing disposed therebetween within said panel light apertures, each of said retainer clips comprising:

a retainer clip body made of a spring steel, longitudinally extending legs depending from opposite longitudinal sides of said clip body said legs flush against on said embossments, oppositely directed and spaced apart trim retainer prongs projecting up from said clip body and generally towards a longitudinal center-line of said clip body, said prongs engaging said frames and securing said glazing between said frames and securing said frames to at least one of said embossments and said legs, and at least two skin spacer tabs extending from said clip body and each of said spacer tabs spaced sufficiently apart from said longitudinally depending legs so as to be able to receive said skins therebetween.

21. A metal door as claimed in claim 20 wherein:

said prongs are bent up projections cut out from said clip body, said trim release means are tabs further cut out from said clip body, and at least one inwardly directed barb is disposed on each of said legs for securing said retainer clip to said skins.

22. A metal door as claimed in claim 21 further comprising hardware mounted on at least one of said outer surfaces of said skins and overlapping a portion of said frames.

23. A metal door as claimed in claim 22 further wherein said hardware comprises a panic device for unlatching the metal door.

24. A panel light assembly for a panel having two spaced apart panel skins and an inner core therebetween, said panel light assembly comprising:

corresponding panel light apertures in each of said skins, edges along the periphery of said apertures, said skins having outer surfaces and front and back frames mounted on said outer surfaces of respective ones of said front and back skins mounted at least partially within said apertures, a plurality of spaced apart retainer clips disposed over said edges for securing said frames and glazing disposed therebetween within said panel light apertures, each of said retainer clips comprising:

a retainer clip body made of a spring steel, longitudinally extending legs depending from opposite longitudinal sides of said clip body said legs flush mounted against said edges, and oppositely directed and spaced apart trim retainer prongs projecting up from said clip body and generally towards a longitudinal center-line of said clip body, said prongs engaging said frames and securing said glazing between said frames and securing said frames to said edges and said legs.

25. A panel light assembly as claimed in claim 24 wherein said retainer clip further comprises at least two skin spacer tabs depending form said clip body and each of said skin spacer tabs is spaces sufficiently apart from said longitudinally extending legs so as to be able to receive said skins therebetween and at least one inwardly directed barb disposed on each of said legs for securing said retainer clip to said skins.

26. A panel light assembly as claimed in claim 25 wherein said prongs are bent up projections cut out from said clip body and said trim release means are tabs further cut out from said clip body.

27. A metal door comprising:

two spaced apart metal skins and an inner core therebetween, a panel light assembly comprising;

corresponding panel light apertures in each of said skins, said skins having outer surfaces and front and back frames mounted on said outer surfaces of respective ones of said front and back skins mounted at least partially within said apertures, embossed edges along the periphery of each of said apertures, said embossed edges forming embossments indented towards said core, retainer clips disposed over edges of said embossments for securing said frames and glazing disposed therebetween within said panel light apertures, each of said retainer clips comprising;

a retainer clip body made of a spring steel, longitudinally extending legs depending from opposite longitudinal sides of said clip body said legs flush against on said embossments, opposite directed and spaced apart trim retainer prongs projecting up from said clip body and generally towards a longitudinal center-line of said clip body, said prongs engaging said frames and securing said glazing between said frames and securing said frames to said edges and said legs, and at least two skin spacer tabs depending from said clip body and each of said skin spacer tabs spaced sufficiently apart from said longitudinally extending legs so as to be able to receive said skins therebetween.

28. A metal door as claimed in claim 27 wherein:

said prongs are bent up projections cut out from said clip body, said trim release means are tabs further cut out from said clip body, and at least one inwardly directed barb is disposed on each of said legs for securing said retainer clip to said skins.

* * * * *